US006094148A

United States Patent [19]

Henry et al.

[11] Patent Number: 6,094,148

[45] Date of Patent: Jul. 25, 2000

[54] VEHICULAR EMERGENCY VEHICLE ALARM APPARATUS

[75] Inventors: Philip L. Henry, Henderson, Nev.; Richard E. Barnett, Natick, Mass.; Lou McKenna, Roseville, Minn.

[73] Assignee: Strobe Detector Technologies, LLC, Henderson, Nev.

[21] Appl. No.: 09/165,214

[22] Filed: Oct. 2, 1998

Related U.S. Application Data

[60] Provisional application No. 60/060,793, Oct. 3, 1997.

[51] Int. Cl.[7] ..... G08G 1/00

[52] U.S. Cl. ..... 340/902; 340/904; 359/154; 359/189; 701/301

[58] Field of Search ..... 340/902, 903, 340/555, 556, 904; 359/154, 189; 701/301

[56] References Cited

U.S. PATENT DOCUMENTS

| | | | |
|---|---|---|---|
| 5,235,329 | 8/1993 | Jackson | 340/902 |
| 5,239,296 | 8/1993 | Jenkins | 340/936 |
| 5,495,243 | 2/1996 | McKenna | 340/902 |
| 5,559,508 | 9/1996 | Orr et al. | 340/902 |

*Primary Examiner*—Daniel J. Wu
*Attorney, Agent, or Firm*—Leydig, Voit & Mayer, Ltd.

[57] ABSTRACT

An apparatus for detecting vehicular speed monitoring signals and for detecting nearby emergency vehicles includes a first sensor for sensing modulated light from an emergency vehicle warning light and generating an alarm signal in response; a second sensor for sensing an incident vehicular speed monitoring signal and generating a ranging signal in response; and an alarm coupled to the first and second sensors for issuing an alarm in response to generation of any of the ranging signal and the alarm signal.

20 Claims, 3 Drawing Sheets

VEHICULAR EMERGENCY VEHICLE ALARM APPARATUS

This application claims benefit of Provisional Application Ser. No. 60/060,793 filed Oct. 3, 1997.

FIELD OF THE INVENTION

The present invention relates to an apparatus for mounting in a vehicle and for detecting incident ranging signals, for example, from a radar transmitter or from a laser light emitter used in monitoring vehicle speed, and for detecting nearby emergency vehicles and providing an alarm to a vehicle occupant.

BACKGROUND OF THE INVENTION

Many operators of motor vehicles employ receiving apparatus for detecting incident ranging signals, i.e., signals transmitted from radar transmitters or laser light emitters employed by police authorities to measure the velocity of the vehicle. Typically, commercially available detectors of ranging signals and laser light used in monitoring vehicle speed, conventionally generically called radar detectors, employ an appropriate sensor and a demodulating circuit connected to the sensor. The sensor may include a conventional antenna for detecting electromagnetic signals in a particular frequency range. The sensor may also include a light sensor, particularly an infrared or laser light sensor, detecting light signals that are sometimes now employed in monitoring vehicle speed. In conventional radar detectors and laser light detectors, upon detection of a signal of interest incident on a vehicle, an alarm is actuated. Typically, the alarm may be a light or an audio signal or both light and audio to obtain the attention of a vehicle occupant promptly.

Vehicular detectors of emergency vehicles, such as ambulances or police vehicles, that are responding to emergencies and provide warnings with flashing lights and/or sirens are also known. An example of such an emergency vehicle alarm system is disclosed in U.S. Pat. No. 5,495,243. The alarm system described in that patent detects light signals, not radio signals, produced by the emergency vehicle lights. Thus, the alarm system is desirably limited to the detection of nearby emergency vehicles, i.e., emergency vehicles within a "line-of-sight". Since radio signals can penetrate stationary objects, a similar detector using radio signals may detect emergency vehicles that are unlikely to be directly encountered. When using light detection only, emergency vehicles that are far away from or not likely to interfere with the movement of the vehicle including the emergency vehicle alarm system are not detected.

Many emergency vehicles are equipped with warning lights that emit both visible and infrared light. The light may be modulated at a relatively low frequency but at a frequency high enough to be undetectable to the eye. That modulation can be employed, with appropriate detectors, for switching traffic signals so that the emergency vehicle can proceed as quickly as possible through intersections by switching all signals to green for the direction of travel of the emergency vehicle and to red for all other directions of vehicle travel. For example, in one known apparatus, the warning light is modulated at a frequency of 14 Hz, although other frequencies, such as up to about 30 Hz, can easily be employed in modulating, i.e., strobing of, the emergency warning light.

SUMMARY OF THE INVENTION

It is an object of the invention to provide an integrated apparatus for a vehicle that can detect both ranging signals from a radar transmitter and/or from a laser light emitter of speed monitoring equipment and modulated light signals from an emergency vehicle warning light and to provide separate and distinct alarms to a vehicle occupant whenever at least one of these three signals is detected.

A vehicular mountable apparatus according to the invention includes a first sensor for sensing modulated light from an emergency vehicle warning light and generating an alarm signal in response; a second sensor for sensing a vehicular speed monitoring signal and generating a ranging signal in response; and an alarm coupled to the first and second sensors for issuing an alarm in response to generation of any of the ranging signal and the alarm signal.

A vehicular mountable apparatus according to the invention includes a demodulator for demodulating incident light signals for detecting a light signal having a modulation frequency within a specified frequency range. The demodulator may include a pulse counter coupled to the first and second sensors for counting pulses produced by the first and second sensors in a fixed length time period and an AND gate receiving the output of the pulse counter for rejecting signals not having a modulation frequency within the specified frequency range and for actuating the alarm, through the AND gate, upon detection of an alarm signal modulated within the specified frequency range.

In an apparatus according to the invention, the alarm provides a visual and/or audio indication of detection of either a ranging signal or an alarm signal. Most preferably, the alarm provides different and distinct indications upon detection of a ranging signal and an alarm signal. Most preferably, both distinct indications can be produced simultaneously. Alternatively, priority of issuing an alarm is provided for the alarm signal, i.e., emergency vehicle detection, over a ranging signal.

In a particularly preferred aspect of the invention, the vehicular mountable apparatus includes a first sensor for sensing modulated light from an emergency vehicle warning light and generating an alarm signal in response, a second sensor for sensing a laser light vehicular speed monitoring signal and generating a laser light ranging signal in response, and a third sensor responsive to a radar vehicular speed monitoring signal and generating a radar ranging signal. The apparatus includes a first demodulator connected between the first sensor and the alarm, demodulating signals produced by the first sensor and generating an alarm signal only when light incident on the first sensor is modulated at a frequency to which the first demodulator is responsive. The apparatus includes a second demodulator connected between the second sensor and the alarm, demodulating signals produced by the second sensor and generating a laser light ranging signal only when light incident on the second sensor is modulated at a frequency to which the second demodulator is responsive. The apparatus also includes a third demodulator connected between the third sensor and the alarm, demodulating signals produced by the third sensor and generating a radar ranging signal only when a radar signal incident on the third sensor is modulated at a frequency to which the third demodulator is responsive. The first, second, and third demodulators are individually connected to the alarm.

According to another aspect of the invention, a vehicular mountable apparatus for detecting vehicular speed monitoring signals and nearby emergency vehicles includes a sensor for sensing a laser light vehicular speed monitoring radar signal and generating a laser light ranging detection signal in response and for sensing a modulated light signal from an emergency vehicle warning light and generating an alarm signal in response; and an alarm coupled to the sensor for issuing an warning in response to generation of any of a laser light ranging signal and an alarm signal.

In the apparatus, the sensor or sensors are preferably multi- or omni-directional.

BRIEF DESCRIPTION OF THE DRAWINGS

In all figures, like elements are given the same reference numbers.

DESCRIPTION OF PREFERRED EMBODIMENTS

Figure 1:
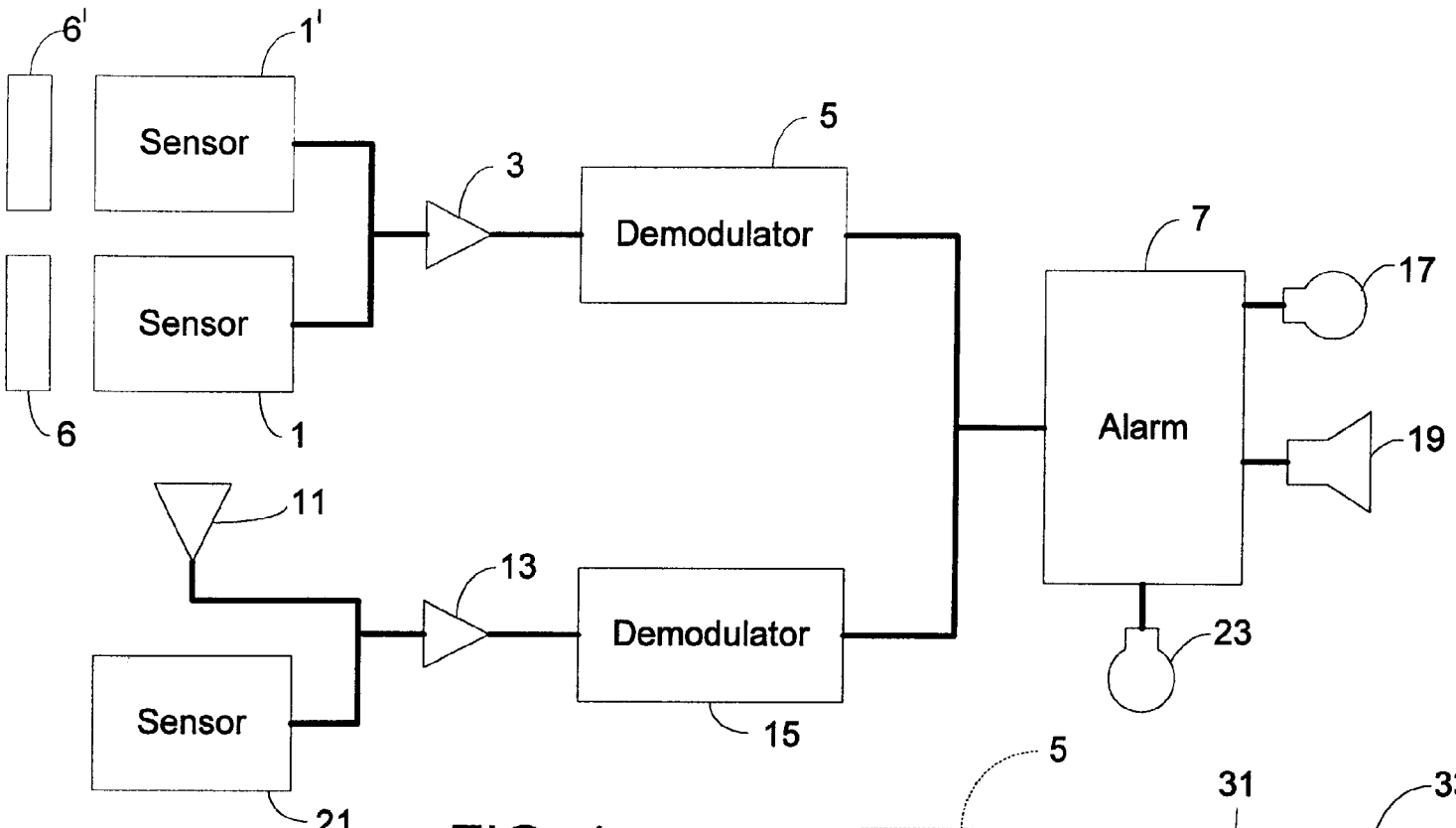
FIG. 1 is a schematic block diagram of an embodiment of an apparatus according to the invention.

FIG. 1 is a schematic block diagram of an apparatus according to the invention. The apparatus includes a light sensor 1 for detecting light produced by a warning light on an emergency vehicle, such as a police car, an ambulance, a fire engine, or like emergency vehicle. The light need not be visible light and the sensor 1 may respond to infrared light and visible light. Although only a single light sensor detecting visible or infrared light may be used, as shown in the embodiment of FIG. 1, the apparatus may include two light sensors, the light sensor 1 and a light sensor 1'. These light sensors may be sensitive to light in different wavelength ranges, such as infrared and visible ranges, or may both be sensitive to infrared light. With two such sensors, for example, both visible and infrared warning light signals can be detected.

In some emergency warning light apparatus, both visible light and infrared light are emitted and both are modulated at a particular strobe rate. The infrared light is provided in these warning lights as a security feature. Traffic signals and like devices that can be triggered by the emergency vehicle warning light are usually sensitive to the infrared light. This sensitivity avoids false triggering that might occur if the traffic signals were exclusively sensitive to visible light. Of course, if only one of the light sensors is used in a detecting apparatus, then, depending upon the sensor, only visible light or infrared light emitted from the emergency vehicle will be detected.

The sensors 1 and 1' may be conventional solid state photocells, such as photovoltaic cells or photoconductive cells. When the sensors 1 and 1' are photovoltaic cells and light of appropriate wavelength is incident on the sensors, a signal is generated by one or both sensors. The signal or signals are fed to an amplifier 3 for increasing the strength of the signal or signals. If one or both of the sensors 1 and 1' is a photocell, then an appropriate bias current must be supplied and the incident light is detected as a change in the current flowing through the photocell.

After amplification in the amplifier 3, the signal produced in response to incident light is supplied to a demodulator 5. The demodulator 5 is tuned to a particular frequency or frequency range of interest so that only signals having the desired modulation are detected and output by the demodulator 5. While the modulation frequency range of the demodulator can be arbitrarily selected, in typical commercially available warning light systems for emergency vehicles the modulation frequencies range from 14 to 30 Hz.

In order to further limit detection to warning lights from emergency vehicles or other desired signals and to increase sensitivity, optical elements 6 and 6' may be placed in front of the sensors 1 and 1', respectively. Each optical element 6 and 6' may include a lens for focusing light and/or an optical band pass filter. Any lenses focus incident light on the most responsive parts of the light sensors 1 and 1'. The focusing increases the effective range of the detector by concentrating the incident light. An optical filter, if present, only transmits light in a wavelength range of interest, considering the spectrum of the light source, avoiding false alarms due to extraneous ambient light. Thus, even if extraneous light should be modulated within the expected strobe frequency range, there will be no detection and no generation of an alarm signal by a photosensor if the light does not have a wavelength within the transmission range of the filter.

When the modulation of the signal produced by the sensor 1 and amplified by the amplifier 3 is not within the frequency range of sensitivity of the demodulator 5, then no alarm signal is produced by the demodulator 5. When produced, the alarm signal is supplied to an alarm 7 described in more detail below. The alarm 7, either a visual indication or an audio indication, or both, alerts the user of the system that an emergency vehicle with its warning lights flashing is within line-of-sight of the sensor 1.

The apparatus of FIG. 1 also includes third and fourth sensors 11 and 21 for sensing an incident ranging signal. Ranging signals, like the warning lights, are typically modulated signals. The sensor 11 may be a conventional radio frequency antenna, such as a horn connected to a waveguide, that is responsive to radio, i.e., radar, frequencies employed in radar vehicular speed monitoring by police and other authorities. The output signal from the sensor 11 is supplied to an amplifier 13 and the amplified signal is supplied to a demodulator 15. If a signal having characteristics to which the demodulator 15 is sensitive, for example, modulation frequency or other characteristics, is produced by the sensor, then a radar ranging signal is produced at the output of the demodulator 15 and supplied to the alarm 7.

In a preferred embodiment, a sensor 21 that is sensitive to laser light used in ranging, i.e., vehicular speed monitoring, is also connected at its output to the amplifier 13. This light sensor 21 may have the same construction as one or both of sensors 1 and 1'. A band pass filter and/or lens (not shown), like optical elements 6 and 6', may concentrate incident light and/or limit the spectrum of light that reaches the light sensor 21 to reduce the possibility of false alarms. The sensor 21 responds to a laser light vehicular speed monitoring signal and produces an output signal. If that output signal has a desired characteristic, such as a modulation frequency, the demodulator 15 produces a laser light ranging signal that is supplied to and triggers the alarm 7. The sensors 11 and 21, together, are responsive to a wide range of electromagnetic signals, from microwaves through invisible to visible light.

The arrangement of the sensors 11 and 21, the amplifier 13, the demodulator 15, and the alarm 7 is conventional and may be identical to known mobile detectors of radar and laser light vehicular speed monitoring signals now available for sale to and used by consumers. Therefore, further detailed discussion of this part of the apparatus of FIG. 1 is not required.

In conventional radar detectors, the alarm 7 may include a light that is illuminated when a ranging signal is produced and/or a speaker or other audio generator producing an audio alarm indicating generation of a ranging signal. In a preferred embodiment of the invention, the alarm 7 has two separate input ports and the indications provided by the alarm 7 are different in response to generation of a ranging signal and an alarm signal. For example, as schematically illustrated in FIG. 1, the generation of the warning signal may cause the alarm 7 to illuminate a light 17 and/or to sound a horn 19 whereas the generation of a ranging signal may cause only a light 21 to be illuminated.

It is preferable that different and mutually exclusive signals be given in response to the generation of each of the warning and ranging signals so that if those signals are generated simultaneously, an indication of the simultaneous warning and alarm signal generation can be given to the operator of the vehicle in which the apparatus is installed. However, since the proximity of an emergency vehicle may require quicker response than the generation of a ranging signal, it is preferable that greater prominence and/or priority be given to the alarm indicating the generation of an alarm signal over a ranging signal. For example, a larger number of lights may be illuminated or a louder horn may be actuated than when a ranging signal is detected separately or simultaneously. Alternatively, the response by the alarm 7 to a ranging signal may be suppressed entirely whenever an alarm signal is being generated.

Figure 2:
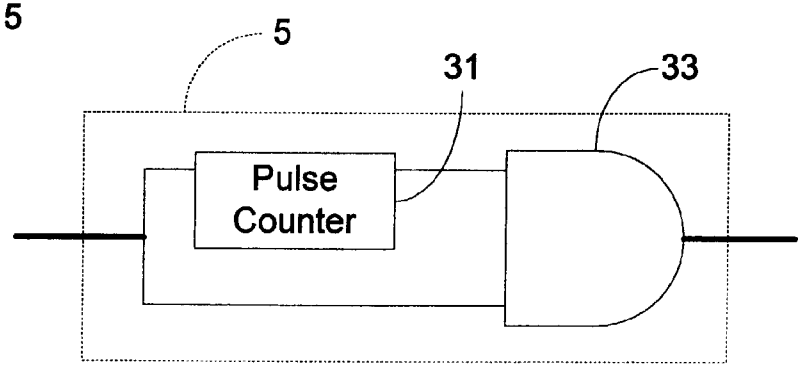
FIG. 2 is a schematic block diagram of a demodulator for an apparatus according to the invention.

FIG. 2 illustrates one example of a demodulator 5. In that exemplary demodulator, the signal from the amplifier 3 is sent along two paths. One of the paths is an input to a pulse counter, explained further below, and the other path is a direct connection to an AND gate 33. The output of the pulse counter 31 is directly connected to the other input of the AND gate 33. The pulse counter 31 may include a zero crossing detector that converts an input signal from the amplifier 3 into a pulsed signal. Then, a pulse counter within the demodulator counts the number of pulses during a fixed period. This pulse counter is reset at the end of each fixed period unless a warning signal is generated at the output of the pulse counter before the expiration of the period. If, during the fixed period, the number of pulses counted equals an established value, based upon a particular strobe frequency of the emergency vehicle warning light, or falls within a range, based on several strobe frequencies of emergency vehicle warning lights, then the warning signal is generated. If too few pulses are counted, then, at the end of the counting period, the counter is reset to zero without the generation of a warning signal. Likewise, if more pulses are counted during the fixed period than the value indicating the strobe rate of an emergency vehicle warning light, no output signal is produced. When an output signal is produced by the pulse counter 31 and supplied to the AND gate 33 at the same time that an incident signal is being detected by either of the sensors 1 and 1', the AND gate produces an output signal that triggers the alarm 7. If the pulse counter fails to output a signal or outputs a signal at a time when there is no incident energy activating either of the sensors 1 and 1', then the alarm 7 cannot be triggered because no output is supplied from the AND gate 33.

Figure 3:
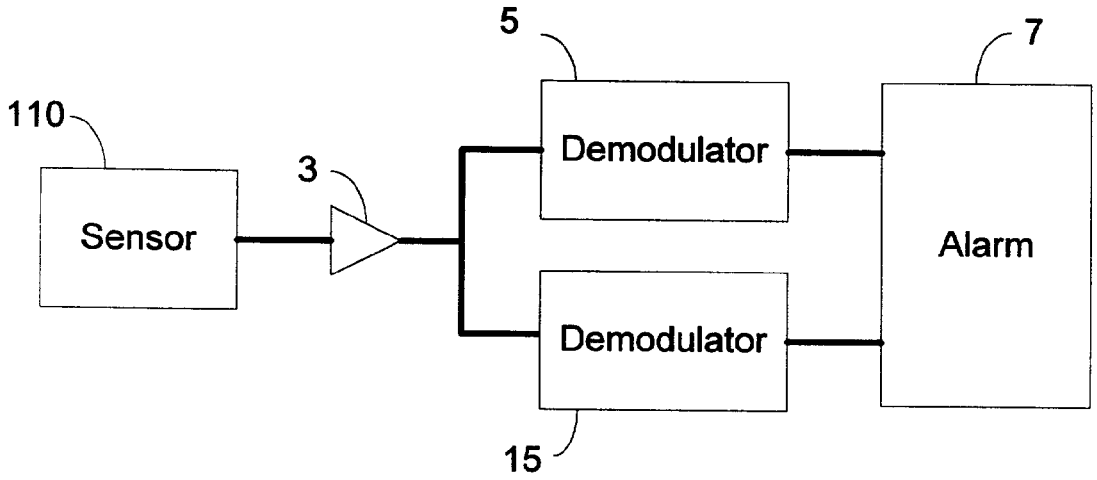
FIG. 3 is a schematic block diagram of an alternative embodiment of an apparatus according to the invention.

FIG. 3 illustrates an alternative embodiment of the invention including a single sensor 110. This embodiment is appropriate when the vehicular speed monitoring signal and the warning light from an emergency vehicle are in the same frequency range of the electromagnetic spectrum. For example, a laser light vehicular speed monitoring signal may be used to produce a response in the sensor 110. The same sensor 110 may be responsive to the infrared or visible component of the emergency vehicle warning light. The sensor 110 may include more than one sensor in an interconnected group of sensors producing one output signal supplied to the amplifier 3, with the amplified signal supplied to both the demodulator 5 and the demodulator 15. These elements are the same as the elements of FIGS. 1 and 2; that is, the demodulator 5 demodulates the input signal and generates an alarm signal whenever the light detected from an emergency vehicle includes a strobe frequency at the tuned frequency of or within the frequency range of the demodulator 5. The demodulator 15 is a conventional demodulator employed in a detector for detecting a laser light vehicular speed monitoring signal and generates a ranging signal as the output signal when the input signal has characteristics indicating detection of a laser light signal of interest. The alarm 7 functions as already described.

Figure 4:
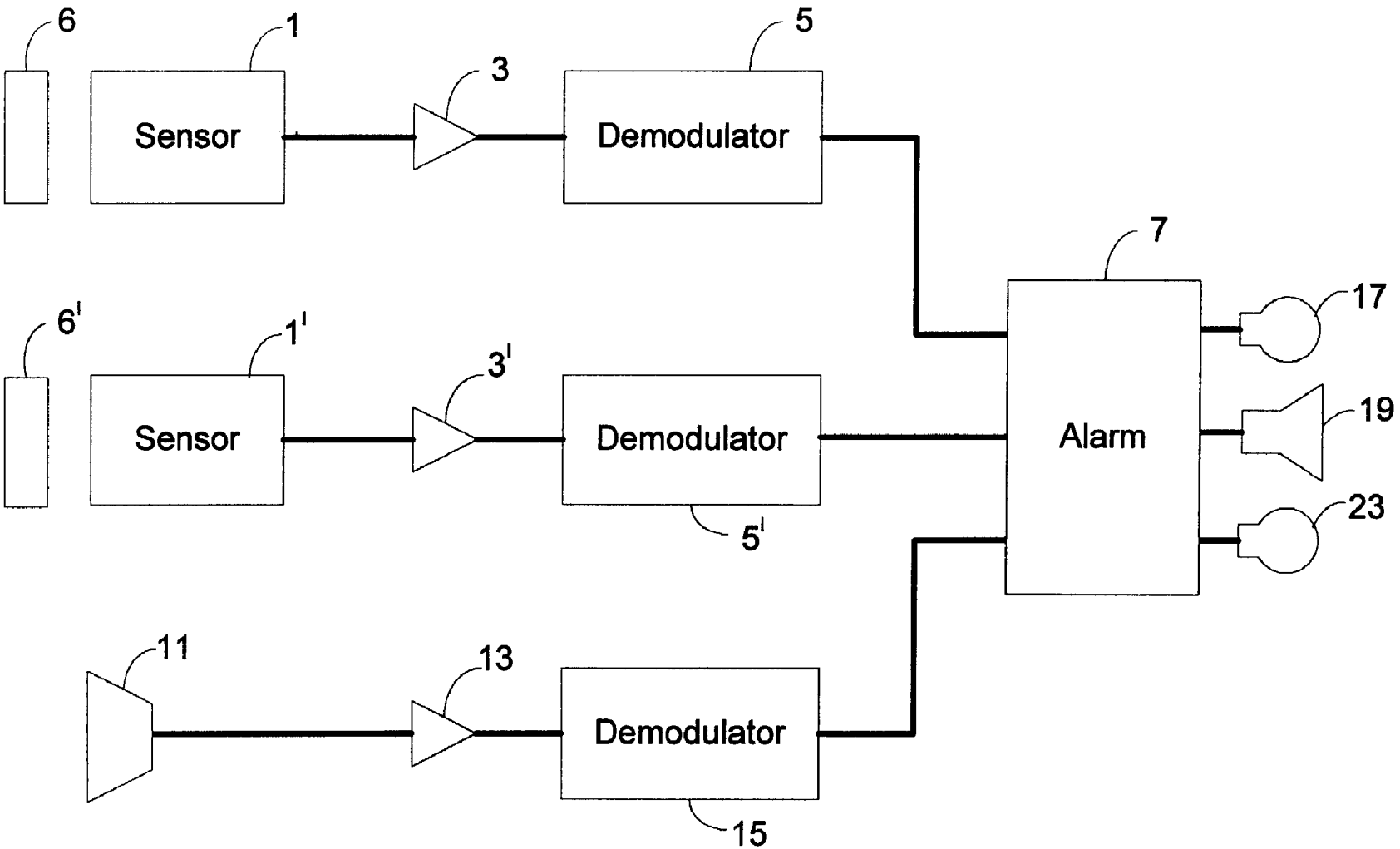
FIG. 4 is a schematic block diagram of another alternative embodiment of an apparatus according to the invention.

FIG. 4 illustrates still another alternative embodiment of the invention, based upon the embodiments of FIGS. 1 and 3. The embodiment of FIG. 4 includes the sensors 1 and 1' along with the corresponding optical elements 6 and 6'. Each sensor has its associated individual amplifier and demodulator. As shown in FIG. 4, the output signal produced by the sensor 1 is amplified by the amplifier 3 and demodulated in the demodulator 5. The signal produced by the demodulator, when a desired signal is detected, for example, an alarm signal, is supplied to the alarm 7. The output signal produced by the sensor 1', for example, a signal in response to a laser light vehicular speed monitoring signal, is amplified in the amplifier 3' and supplied to the demodulator 5'. The sensor 1 may respond to a warning signal produced by a light of an emergency vehicle. If that detected signal has a characteristic of interest, for example, a particular modulation frequency to which the demodulator 5 is responsive, then the demodulator 5 produces an alarm signal that is supplied to the alarm 7. If the detected laser light vehicular speed monitoring signal has a modulation characteristic, e.g., frequency, to which the demodulator 5' is responsive, then the demodulator 5' produces a laser light ranging signal that is supplied to the alarm 7.

The embodiment of FIG. 4 also includes a sensor 11. The sensor 11 is a radio frequency antenna, for example, a horn, that produces an electrical signal in response to an incident radar vehicular speed monitoring signal. The output signal, if any, from the sensor 11 is amplified in the amplifier 13 and supplied to the demodulator 15. If the amplified signal has a characteristic of interest, for example, a particular modulation frequency to which the demodulator 15 responds, then the demodulator 15 produces a radar ranging signal that is supplied to the alarm 7. The alarm 7 responds to the alarm signal, the laser light ranging signal, and the radar ranging signal when one, two, or all three of the signals are present, by providing visual and/or audio responses, as previously described. Preferably, different indications are provided to distinguish which signals are present at the alarm 7 and, most preferably, priority is given to indicating the presence of an alarm signal as compared to the presence of a radar ranging signal and a laser light ranging signal.

Although the embodiments of the apparatus described are intended to detect both an incident vehicular speed monitoring signal and a strobed warning light from an emergency vehicle, an apparatus that detects and warns of an emergency vehicle alone is within the scope of this disclosure. Such an apparatus is, in one embodiment, identical to FIG. 1 without sensors 11 and 12, amplifier 13, and demodulator 15. Operation is the same as that already described with respect to the upper half of FIG. 1 and, therefore, is not repeated.

The sensors of the apparatus, whether a single sensor or multiple sensors as in the embodiment of FIG. 1 or a unified sensor as in the apparatus of FIG. 3, may be located anywhere on a vehicle. Most preferably, all sensors are omni-directional. In a less preferred apparatus, sensors may have a three-dimensional sector within which incident signals are detected with the sector directed only toward the front and rear of the vehicle. Multiple sensors with limited angular ranges of sensitivity may be connected together to broaden coverage, i.e., increase the sector of response. Preferably, at least the sensor or sensors for emergency vehicles is located relatively high on the vehicle to maximize the length of the line-of-sight path.

The invention has been described with respect to certain preferred embodiments. Various modifications and additions within the spirit and scope of the invention will occur to those of skill in the art from this disclosure. Accordingly, the invention is not limited by the foregoing description and is defined solely by the following claims.

We claim:

1. A vehicular mountable apparatus for detecting vehicular speed monitoring signals and for detecting nearby emergency vehicles comprising:

a first sensor for sensing modulated light from an emergency vehicle warning light and generating an alarm signal in response;

a second sensor for sensing a vehicular speed monitoring signal and generating a ranging signal in response; and an alarm coupled to the first and second sensors for issuing an alarm in response to generation of any of the ranging signal and the alarm signal.

2. The apparatus of claim 1 wherein the first sensor is responsive to light.

3. The apparatus of claim 1 wherein the first and second sensors are responsive to light.

4. The apparatus of claim 1 wherein the second sensor is a radar sensor responsive to a radar vehicular speed monitoring signal.

5. The apparatus of claim 1 including a first demodulator connected between the first sensor and the alarm, demodulating signals produced by the first sensor and generating an alarm signal only when light incident on the first sensor is modulated at a frequency to which the first demodulator is responsive.

6. The apparatus of claim 5 wherein the first demodulator includes a pulse counter coupled to the first sensor for counting pulses produced by the first sensor in a fixed length time period and an AND gate receiving the outputs of the pulse counter and the first sensor for comparing pulses counted in the fixed length time period to at least one frequency to which the first demodulator is responsive and for rejecting frequencies not corresponding to the modulated frequency to which the first demodulator is responsive.

7. The apparatus of claim 5 including a second demodulator connected between the second sensor and the alarm, demodulating signals produced by the second sensor and generating a ranging signal only when a signal incident on the second sensor is modulated at a frequency to which the second demodulator is responsive.

8. The apparatus of claim 4 including a third sensor for sensing a laser light vehicular speed monitoring signal.

9. The apparatus of claim 8 including:

a first demodulator connected between the first sensor and the alarm, demodulating signals produced by the first sensor and generating an alarm signal only when light incident on the first sensor is modulated at a frequency to which the first demodulator is responsive;

a second demodulator connected between the second sensor and the alarm, demodulating signals produced by the second sensor and generating a radar ranging signal only when a signal incident on the second sensor is modulated at a frequency to which the second demodulator is responsive; and a third demodulator connected between the third sensor and the alarm, demodulating signals produced by the third sensor and generating a laser light ranging signal only when light incident on the third sensor is modulated at a frequency to which the third demodulator is responsive.

10. The apparatus of claim 9 wherein the alarm produces a visual and/or an audio alarm in response to generation of any of an alarm signal, a radar ranging signal, and a laser light ranging signal.

11. The apparatus of claim 10 wherein the alarm gives priority in responding to an alarm signal over simultaneously generated radar and laser light ranging signals.

12. The apparatus of claim 1 wherein the second sensor comprises a radar sensor for detecting radar vehicular speed monitoring signals and a laser light sensor for detecting laser light vehicular speed monitoring signals.

13. The apparatus of claim 1 wherein the alarm produces a visual and/or an audio alarm in response to generation of any of an alarm signal and a ranging signal.

14. The apparatus of claim 13 wherein the alarm gives priority in responding to an alarm signal over a simultaneously generated ranging detection signal.

15. A vehicular mountable apparatus for detecting vehicular speed monitoring signals and for detecting nearby emergency vehicles comprising:

a sensor for sensing a laser light vehicular speed monitoring signal and generating a laser light ranging detection signal in response and for sensing a modulated light signal from an emergency vehicle warning light and generating an alarm signal in response; and an alarm coupled to the sensor for issuing an alarm in response to generation of any of a laser light ranging signal and an alarm signal.

16. The apparatus of claim 15 including first and second demodulators connected between the sensor and the alarm, the first demodulator demodulating a signal produced in response to a laser light vehicular speed monitoring signal, generating a laser light ranging detection signal when light incident on the sensor is modulated at a frequency to which the first demodulator is responsive, the second demodulator demodulating a signal produced in response to an incident modulated light signal from an emergency vehicle warning light and generating an alarm signal when light incident on the sensor is modulated at a frequency to which the second demodulator is responsive.

17. The apparatus of claim 16 wherein the alarm provides different indications in response to generation of a laser light ranging signal and generation of an alarm signal.

18. The apparatus of claim 15 wherein the alarm produces a visual and/or an audio alarm in response to generation of any of an alarm signal and a laser light ranging signal.

19. A vehicular mountable apparatus for detecting nearby emergency vehicles comprising:

a sensor for sensing incident modulated light from an emergency vehicle warning light and generating an alarm signal in response;

an alarm coupled to the sensor for issuing an alarm in response to generation of an alarm signal; and a demodulator connected between the sensor and the alarm for demodulating signals produced by the sensor and for generating an alarm signal only when the incident light is modulated at a frequency to which the demodulator is responsive, the demodulator including a pulse counter coupled to the sensor for counting pulses produced by the sensor in a fixed length time period and an AND gate receiving the outputs of the pulse counter and the sensor for comparing pulses counted in the fixed length time period to at least one frequency to which the demodulator is responsive and for rejecting frequencies not corresponding to the modulated frequency to which the demodulator is responsive.

20. The apparatus of claim 19 wherein the alarm produces a visual indication and/or an audio alarm in response to generation of an alarm signal.

* * * * *